US006910758B2

(12) United States Patent
Truninger et al.

(10) Patent No.: US 6,910,758 B2
(45) Date of Patent: Jun. 28, 2005

(54) SUBSTRATE AND METHOD OF FORMING SUBSTRATE FOR FLUID EJECTION DEVICE

(75) Inventors: Martha A. Truninger, Corvallis, OR (US); Steven David Leith, Albany, OR (US); Jeffery S. Hess, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 169 days.

(21) Appl. No.: 10/619,639

(22) Filed: Jul. 15, 2003

(65) Prior Publication Data

US 2005/0012772 A1 Jan. 20, 2005

(51) Int. Cl.[7] ..... B41J 2/16
(52) U.S. Cl. ..... 347/47
(58) Field of Search ..... 347/47, 44, 40, 347/20, 9, 1, 7, 5, 84, 85, 86, 54, 68, 57, 56, 55

(56) References Cited

U.S. PATENT DOCUMENTS

| | | | |
|---|---|---|---|
| 5,124,717 | A | 6/1992 | Campanelli et al. |
| 5,141,596 | A | 8/1992 | Hawkins et al. |
| 5,385,635 | A | 1/1995 | O'Neill |
| 5,387,314 | A | 2/1995 | Baughman et al. |
| 5,393,711 | A | 2/1995 | Biallas et al. |
| 5,441,593 | A | 8/1995 | Baughman et al. |
| 5,498,312 | A | 3/1996 | Laermer et al. |
| 5,501,893 | A | 3/1996 | Laermer et al. |
| 5,526,454 | A | 6/1996 | Mayer |
| 5,541,140 | A | 7/1996 | Goebel et al. |
| 5,716,533 | A | 2/1998 | O'Neill et al. |
| 5,756,901 | A | 5/1998 | Kurle et al. |
| 5,870,123 | A | 2/1999 | Lorenze, Jr. et al. |
| 6,008,138 | A | 12/1999 | Laermer et al. |
| 6,045,710 | A | 4/2000 | Silverbrook |
| 6,081,635 | A | 6/2000 | Hehmann |
| 6,096,656 | A | 8/2000 | Matzke et al. |
| 6,139,761 | A | 10/2000 | Ohkuma |
| 6,305,080 | B1 | 10/2001 | Komuro et al. |
| 6,481,832 | B2 | 11/2002 | Liu et al. |

FOREIGN PATENT DOCUMENTS

| | | |
|---|---|---|
| DE | 19538103 A1 | 4/1997 |
| EP | 0865151 A2 | 9/1998 |
| EP | 0886307 A2 | 12/1998 |
| EP | 0978832 A2 | 2/2000 |
| GB | 2245366 A | 1/1992 |
| GB | 2290413 A | 12/1995 |
| GB | 2341348 A | 3/2000 |
| WO | WO 9837577 | 8/1998 |
| WO | WO 0023376 | 4/2000 |

OTHER PUBLICATIONS

"Anisotropic Silicon Etch Characterization in the TFTL STS Etcher"; Aug. 20, 1999; pp: 1–5.

"Etching Characteristics And Profile Control in a Time Multiplexed Inductively Coupled Plasma Etcher"; by: AA Ayon, CC Lin, RA Braff & MA Schmidt of the Department of Electrical Engineering and Computer Science (EECS); Solid–State Sensor and Actuator Workshop, Hilton Head Island, SC; Jun. 8–11, 1998; pp: 41–44.

(Continued)

*Primary Examiner*—Raquel Yvette Gordon

(57) ABSTRACT

A method of forming an opening through a substrate having a first side and a second side opposite the first side includes forming spaced stops in the first side of the substrate, partially forming a first portion of the opening in the substrate from the second side by a first process, further forming the first portion of the opening in the substrate from the second side by a second process, including forming the first portion of the opening to the spaced stops, and forming a second portion of the opening in the substrate from the first side, including forming the second portion of the opening between the spaced stops.

56 Claims, 7 Drawing Sheets

"Characterization of a Time Multiplexed Inductively Coupled Plasma Etcher"; by: AA Ayon, R Braff, CC Lin, HH Sawin & MA Schmidt; Journal of the Electrochemical Society; 146 (1); 1999; pp: 339–349.

"Cryogenic Etching of Deep Narrow Trenches in Silicon"; by: Aachboun et al.; Journal Of Vacuum Science & Technology A; vol. 18, No. 4; pt. 1–2; Jul.–Aug. 2000; Abstract Only.

"An Array of Hollow Microcapillaries For The Controlled Injection of Genetic Materials Into Animal/Plant Cells"; by: K. Chun et al.; Proceedings of 12th International Workshop on Micro Electro Mechanical Systems (MEMS); Jan. 1999; Abstract Only.

"Deep Etching Key to the MEMS/MST Revolution"; by: Prashant Gadil; R & D; Jul. 1998; p. 38.

STS–Surface Technology Systems–1st ASE Users Meeting, pp. 1–10; Advanced Silicon Etch, pp. 1–28; Technology Review, pp. 1–10; California, 1997.

"High–Aspect–Ratio Si Etching for Microsensor Fabrication"; by; WH Juan & SW Pang; Journal of Vacuum Science & Technology A; vol. 13, No. 3; 1995; pp: 834–838.

"Bosch Deep Silicon Etching: Improved Uniformity and Etch Rate for Advanced MEMS Applications"; by: F Laermer et al.; 0–7803–5194–00; 1999; pp. 211–216.

"Advanced Silicon Etching Using High Density Plasmas"; by; JK Bhardwaj & H Ashraf; SPIE–Society of Photo–Optical Instrumentation Engineers; vol. 2639; Oct. 1995; pp 224–233.

"Recent Advances in Silicon Etching for MEMS Using the ASE Process"; by: AM Hynes et al.; Sensors And Actuators; vol. 74; 1999; pp 13–17.

"Fabrication of Thick Silicon Dioxide Layers Using DRIE, Oxidation and Trench Refill"; by: C Zhang & K Najafi; Proceedings of 15th IEEE International Conference on Micro Electro Mechanical Systems; Jan. 20–24, 2002; pp. 160–163.

"Fabrication of Out–of–Plane Curved Surfaces in Si by Utilizing RIE Lag"; by: TA Chou & K Najafi; Proceedings of 15th IEEE International Conference on Micro Electro Mechanical Systems; Jan. 20–24, 2002; pp. 145–148.

SUBSTRATE AND METHOD OF FORMING SUBSTRATE FOR FLUID EJECTION DEVICE

BACKGROUND OF THE INVENTION

In some fluid ejection devices, such as printheads, a drop ejecting element is formed on a front side of a substrate and fluid is routed to an ejection chamber of the drop ejecting element through an opening or slot in the substrate. Often, the substrate is a silicon wafer and the slot is formed in the wafer by chemical etching. Methods of forming the slot through the substrate include etching into the substrate from both the front side and the backside so as to form a front side opening and a backside opening in the substrate.

Unfortunately, since a portion of the slot is formed by etching into the substrate from the front side and a portion of the slot is formed by etching into the substrate from the backside, misalignment between the backside opening and the front side opening of the slot may occur. Such misalignment may result, for example, in undercutting of one or more layers formed on the front side of the substrate.

For these and other reasons, there is a need for the present invention.

SUMMARY OF THE INVENTION

One aspect of the present invention provides a method of forming an opening through a substrate having a first side and a second side opposite the first side. The method includes forming spaced stops in the first side of the substrate, partially forming a first portion of the opening in the substrate from the second side by a first process, further forming the first portion of the opening in the substrate from the second side by a second process, including forming the first portion of the opening to the spaced stops, and forming a second portion of the opening in the substrate from the first side, including forming the second portion of the opening between the spaced stops.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the FIGURES(S) being described. Because components of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
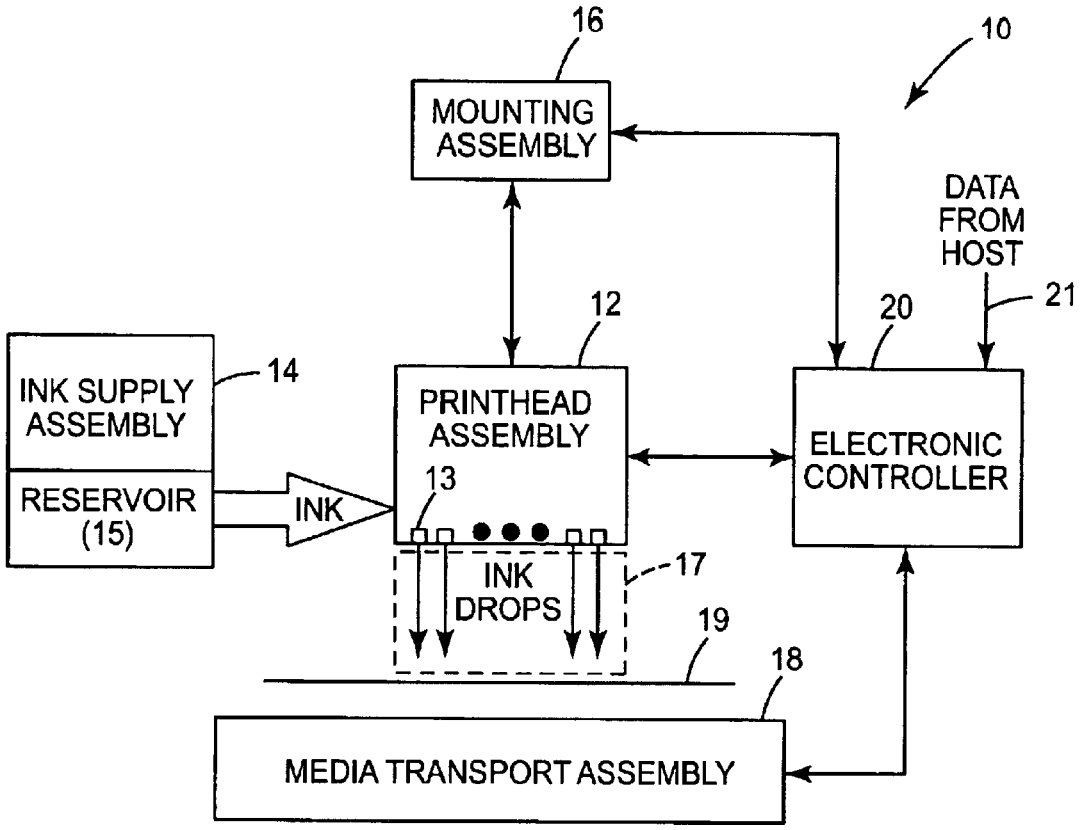
FIG. 1 is a block diagram illustrating one embodiment of an ink-jet printing system according to the present invention.

FIG. 1 illustrates one embodiment of an inkjet printing system 10 according to the present invention. Inkjet printing system 10 constitutes one embodiment of a fluid ejection system which includes a fluid ejection assembly, such as an inkjet printhead assembly 12, and a fluid supply assembly, such as an ink supply assembly 14. In the illustrated embodiment, inkjet printing system 10 also includes a mounting assembly 16, a media transport assembly 18, and an electronic controller 20. Inkjet printhead assembly 12, as one embodiment of a fluid ejection assembly, is formed according to an embodiment of the present invention, and includes one or more printheads or fluid ejection devices which eject drops of ink or fluid through a plurality of orifices or nozzles 13. In one embodiment, the drops are directed toward a medium, such as print medium 19, so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes, in one embodiment, characters, symbols, and/or other graphics or images to be printed upon print medium 19 as inkjet printhead assembly 12 and print medium 19 are moved relative to each other.

Ink supply assembly 14, as one embodiment of a fluid supply assembly, supplies ink to printhead assembly 12 and includes a reservoir 15 for storing ink. As such, in one embodiment, ink flows from reservoir 15 to inkjet printhead assembly 12. In this embodiment, ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, a portion of the ink not consumed during printing is returned to ink supply assembly 14.

In one embodiment, inkjet printhead assembly 12 and ink supply assembly 14 are housed together in an inkjet or fluidjet cartridge or pen. In another embodiment, ink supply assembly 14 is separate from inkjet printhead assembly 12 and supplies ink to inkjet printhead assembly 12 through an interface connection, such as a supply tube (not shown). In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge and/or a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller 20 communicates with inkjet printhead assembly 12, mounting assembly 16, and media transport assembly 18. Electronic controller 20 receives data 21 from a host system, such as a computer, and includes memory for temporarily storing data 21. Typically, data 21 is sent to ink-jet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of ink-jet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Figure 2:
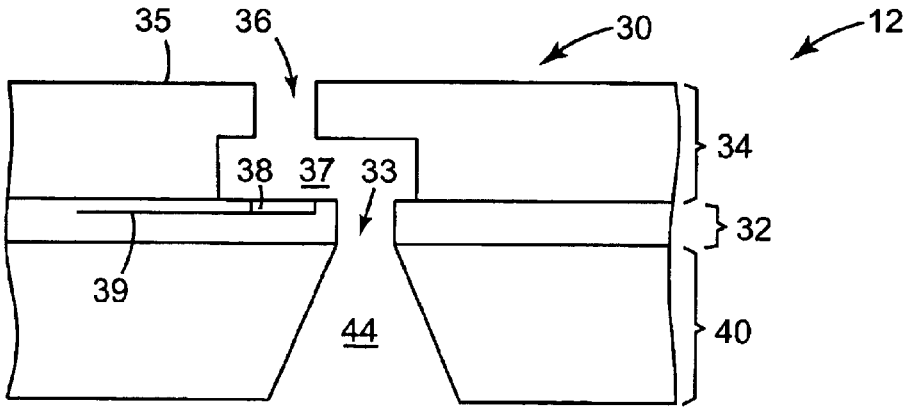
FIG. 2 is a schematic cross-sectional view illustrating one embodiment of a portion of a fluid ejection device according to the present invention.

FIG. 2 illustrates one embodiment of a portion of inkjet printhead assembly 12. Inkjet printhead assembly 12, as one embodiment of a fluid ejection assembly, includes an array of drop ejecting elements 30. Drop ejecting elements 30 are formed on a substrate 40 which has a fluid (or ink) feed slot 44 formed therein. As such, fluid feed slot 44 provides a supply of fluid (or ink) to drop ejecting elements 30.

In one embodiment, each drop ejecting element 30 includes a thin-film structure 32, an orifice layer 34, and a firing resistor 38. Thin-film structure 32 has a fluid (or ink) feed channel 33 formed therein which communicates with fluid feed slot 44 of substrate 40. Orifice layer 34 has a front face 35 and a nozzle opening 36 formed in front face 35. Orifice layer 34 also has a nozzle chamber 37 formed therein which communicates with nozzle opening 36 and fluid feed channel 33 of thin-film structure 32. Firing resistor 38 is positioned within nozzle chamber 37 and includes leads 39 which electrically couple firing resistor 38 to a drive signal and ground.

In one embodiment, during operation, fluid flows from fluid feed slot 44 to nozzle chamber 37 via fluid feed channel 33. Nozzle opening 36 is operatively associated with firing resistor 38 such that droplets of fluid are ejected from nozzle chamber 37 through nozzle opening 36 (e.g., normal to the plane of firing resistor 38) and toward a medium upon energization of firing resistor 38.

Example embodiments of inkjet printhead assembly 12 include a thermal printhead, a piezoelectric printhead, a flex-tensional printhead, or any other type of fluid ejection device known in the art. In one embodiment, inkjet printhead assembly 12 is a fully integrated thermal inkjet printhead. As such, substrate 40 is formed, for example, of silicon, glass, or a stable polymer, and thin-film structure 32 is formed by one or more passivation or insulation layers of silicon dioxide, silicon carbide, silicon nitride, tantalum, poly-silicon glass, or other suitable material. Thin-film structure 32 also includes a conductive layer which defines firing resistor 38 and leads 39. The conductive layer is formed, for example, by aluminum, gold, tantalum, tantalum-aluminum, or other metal or metal alloy.

Figure 3:
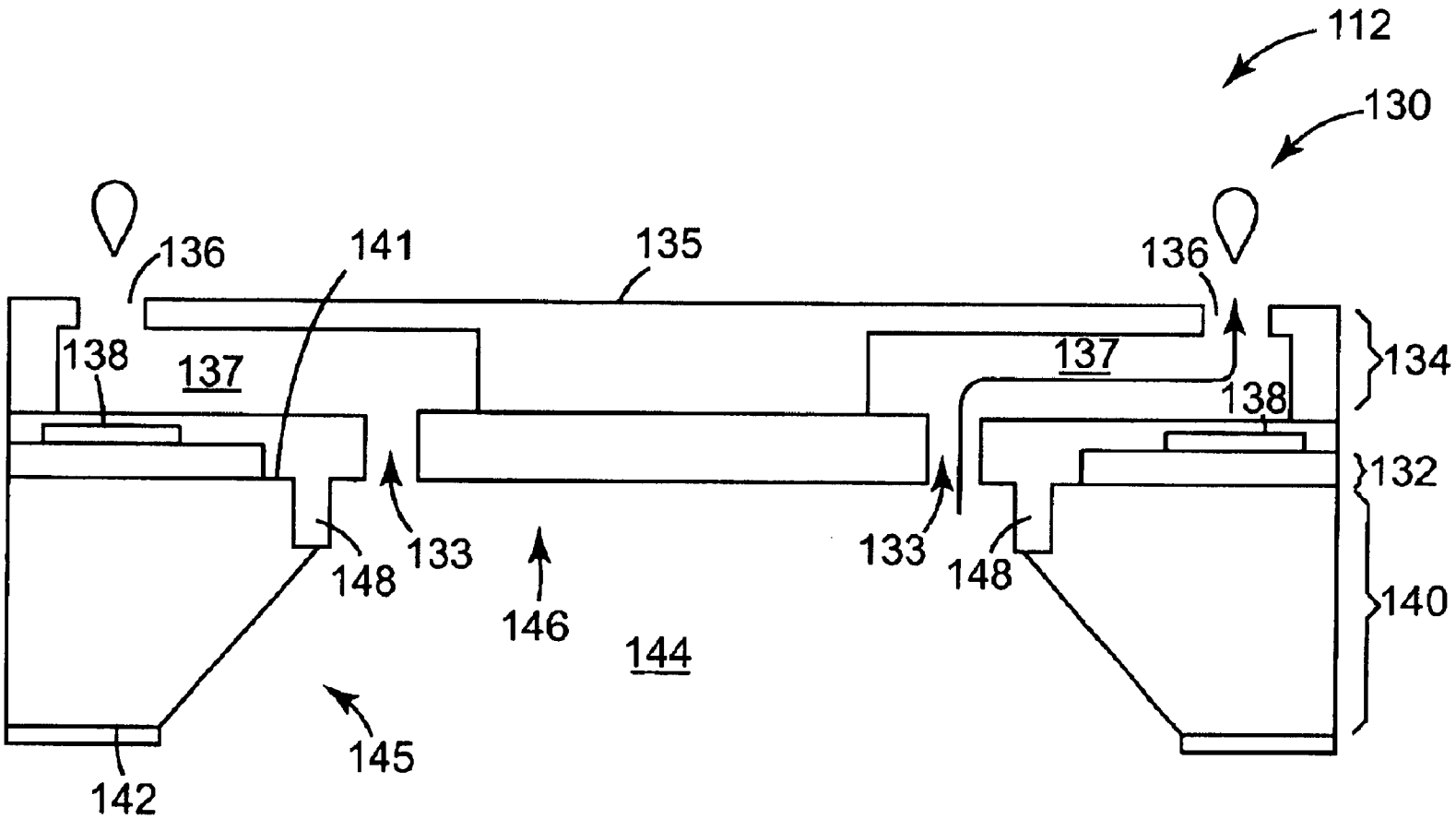
FIG. 3 is a schematic cross-sectional view illustrating one embodiment of a fluid ejection device formed on one embodiment of a substrate according to the present invention.

FIG. 3 illustrates another embodiment of a portion of inkjet printhead assembly 12. Inkjet printhead assembly 112, as another embodiment of a fluid ejection assembly, includes an array of drop ejecting elements 130. Drop ejecting elements 130 are formed on a substrate 140 which has a fluid (or ink) feed slot 144 formed therein. As such, fluid feed slot 144 provides a supply of fluid (or ink) to drop ejecting elements 130.

In one embodiment, drop ejecting elements 130 include a thin-film structure 132, an orifice layer 134, and firing resistors 138. Thin-film structure 132 has fluid (or ink) feed channels 133 formed therein which communicate with fluid feed slot 144 of substrate 140. Orifice layer 134 has a front face 135 and nozzle openings 136 formed in front face 135. Orifice layer 134 also has nozzle chambers 137 formed therein which communicate with respective nozzle openings 136 and respective fluid feed channels 133 of thin-film structure 132.

In one embodiment, during operation, fluid flows from fluid feed slot 144 to nozzle chambers 137 via respective fluid feed channels 133. Nozzle openings 136 are operatively associated with respective firing resistors 138 such that droplets of fluid are ejected from nozzle chambers 137 through nozzle openings 136 and toward a medium upon energization of firing resistors 138 positioned within respective nozzle chambers 137.

As illustrated in the embodiment of FIG. 3, substrate 140 has a first side 141 and a second side 142. Second side 142 is opposite of first side 141 and, in one embodiment, oriented substantially parallel with first side 141. Fluid feed slot 144 communicates with first side 141 and second side 142 of substrate 140 so as to provide a channel or passage through substrate 140.

In one embodiment, fluid feed slot 144 includes a first portion 145 and a second portion 146. First portion 145 is formed in and communicates with second side 142 of substrate 140 and second portion 146 is formed in and communicates with first side 141 of substrate 140. First portion 145 and second portion 146 communicate with each other so as to form fluid feed slot 144 through substrate 140. Fluid feed slot 144, including first portion 145 and second portion 146, is formed in substrate 140 according to an embodiment of the present invention. In one embodiment, fluid feed slot 144, including first portion 145 and second portion 146, is formed in substrate 140 by chemical etching, as described below.

In one embodiment, substrate 140 includes spaced stops 148. Stops 148 extend into substrate 140 from first side 141 and, in one embodiment, are oriented substantially perpendicular to first side 141. Stops 148 control etching of substrate 140 and, therefore, formation of first portion 145 and second portion 146 of fluid feed slot 144. As such, stops 148 are formed of a material which is resistant to etchant used for etching substrate 140, as described below. Thus, stops 148 constitute etch stops of substrate 140.

Stops 148 define and control formation of fluid feed slot 144 in substrate 140. More specifically, stops 148 limit fluid feed slot 144 and define a maximum dimension of second portion 146 and a minimum dimension of first portion 145 of fluid feed slot 144. In addition, stops 148 establish a location of second portion 146 at first side 141 and accommodate misalignment between first portion 145 and second portion 146, as described below. Furthermore, stops 148 provide for self-alignment between first portion 145 and second portion 146 of fluid feed slot 144.

FIGS. 4A–4J illustrate one embodiment of forming an opening 150 through a substrate 160. In one embodiment, substrate 160 is a silicon substrate and opening 150 is formed in substrate 160 by chemical etching, as described below. Substrate 160 has a first side 162 and a second side 164. Second side 164 is opposite of first side 162 and, in one embodiment, oriented substantially parallel with first side 162. Opening 150 communicates with first side 162 and second side 164 of substrate 160 so as to provide a channel or passage through substrate 160. While only one opening 150 is illustrated as being formed in substrate 160, it is understood that any number of openings 150 may be formed in substrate 160.

In one embodiment, substrate 160 represents substrate 140 of ink-jet printhead assembly 112 and opening 150 represents fluid feed slot 144 formed in substrate 140. As such, drop ejecting elements 130 of inkjet printhead assembly 112 are formed on first side 162 of substrate 160. Thus, first side 162 forms a front side of substrate 160 and second side 164 forms a backside of substrate 160 such that fluid flows through opening 150 and, therefore, substrate 160 from the backside to the front side. Accordingly, opening 150 provides a fluidic channel for the communication of ink with drop ejecting elements 130 through substrate 160.

In one embodiment, opening 150 is formed in substrate 160 after drop ejecting elements 130 are formed on substrate 160. More specifically, opening 150 is formed in substrate 160 after thin-film structure 132, firing resistors 138, and orifice layer 134 are formed on first side 162 of substrate 160. In one embodiment, processing of substrate 160 for forming opening 150 is started after thin-film structure 132 and firing resistors 138 of drop ejecting elements 130 are formed on first side 162 of substrate 160.

As illustrated in the embodiments of FIGS. 4A–4D, before opening 150 is formed, etch stops 170 are formed in substrate 160. In one embodiment, etch stops 170 are formed in substrate 160 by chemical etching into substrate 160 and disposing an etch resistant material in substrate 160, as described below.

Figure 4A:
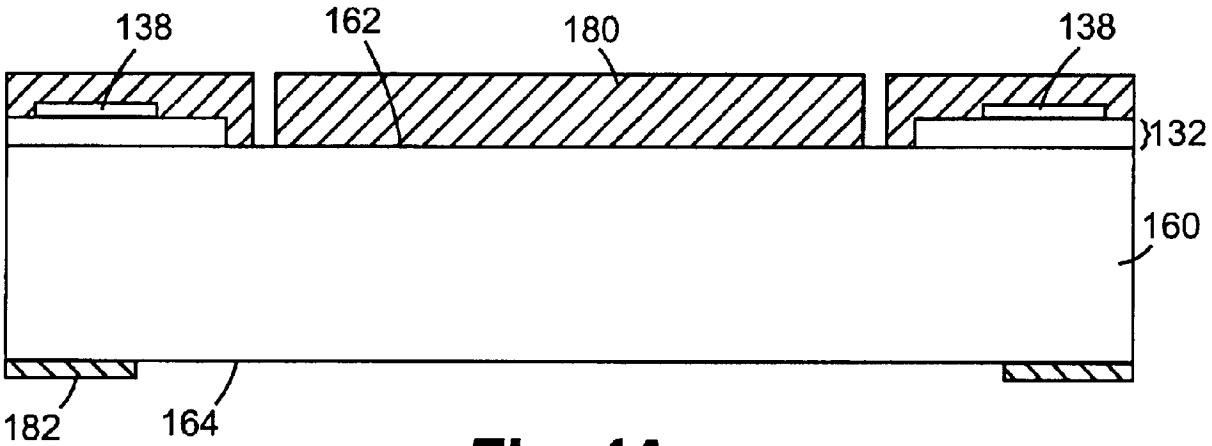
FIGS. 4A–4J illustrate one embodiment of forming an opening through a substrate according to the present invention.

In one embodiment, as illustrated in the embodiment of FIG. 4A, to form etch stops 170 in substrate 160, a masking layer 180 is formed on substrate 160. More specifically, masking layer 180 is formed on first side 162 of substrate 160. Masking layer 180 is used to selectively control or block etching of first side 162. As such, masking layer 180 is formed along first side 162 of substrate 160 and patterned to expose areas of first side 162 and define where etch stops 170 are to be formed in substrate 160. In one embodiment, masking layer 180 is formed over thin-film structure 132 and firing resistors 138.

In one embodiment, masking layer 180 is formed by deposition and patterned by photolithography and etching to define exposed portions of first side 162 of substrate 160. More specifically, masking layer 180 is patterned to outline where slots 166 (FIG. 4B) are to be formed in substrate 160 from first side 162. In one embodiment, slots 166 are formed in substrate 160 by chemical etching, as described below. Thus, masking layer 180 is formed of a material which is resistant to etchant used for etching slots 166 into substrate 160. Examples of a material suitable for masking layer 180 include silicon dioxide, silicon nitride, or photoresist.

Also, as illustrated in the embodiment of FIG. 4A, a masking layer 182 is formed on second side 164 of substrate 160. In one embodiment, masking layer 182 is formed by growing an oxide on second side 164. The oxide is resistant to the etchant selected for use in etching opening 150 through substrate 160, as described below. The oxide may include, for example, silicon dioxide. Masking layer 182 is patterned to expose an area of second side 164 and define where substrate 160 is to be etched to form a portion of opening 150 (FIGS. 4I–4J).

Figure 4B:
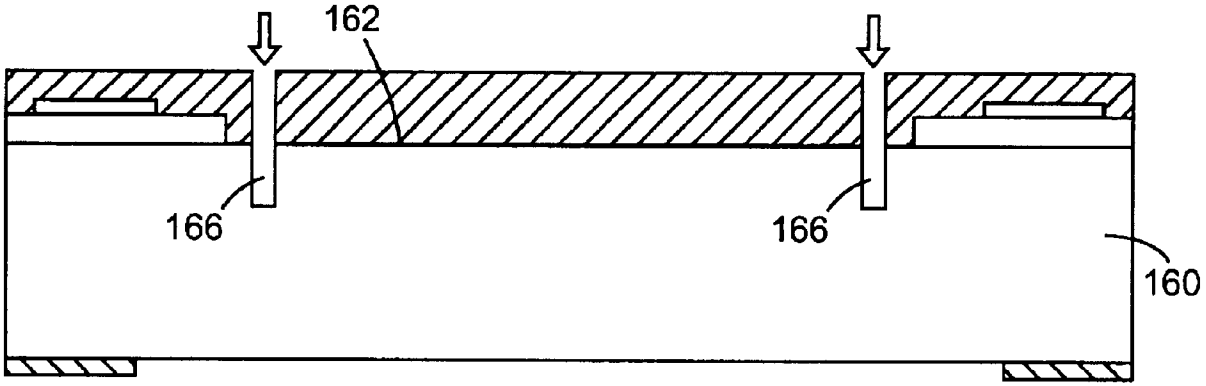

Next, as illustrated in the embodiment of FIG. 4B, slots 166 are formed in substrate 160. More specifically, slots 166 are formed in substrate 160 by etching into first side 162. Slots 166 include at least one pair of slots spaced along first side 162 so as to define where opening 150 is to communicate with first side 162. In one embodiment, slots 166 are oriented substantially perpendicular to first side 162 and are formed in substrate 160 using an anisotropic etch process which forms slots 166 with substantially parallel sides. In one embodiment, the etch process is a dry etch such as a plasma based fluorine ($SF_6$) etch. In a particular embodiment, the dry etch is a reactive ion etch (RIE) and, more specifically, a deep RIE (DRIE).

During the deep RIE, an exposed section is alternatively etched with a reactive etching gas and coated until a slot is formed. In one exemplary embodiment, the reactive etching gas creates a fluorine radical that chemically and/or physically etches the substrate. In this exemplary embodiment, a polymer coating that is selective to the etchant used is deposited on inside surfaces of the forming slot, including the sidewalls and bottom. The coating is created by using carbon-fluorine gas that deposits $(CF_2)_n$, a low surface energy fluorinated hydrocarbon, on these surfaces. In this embodiment, the polymer substantially prevents etching of the sidewalls during the subsequent etch(es). The gases for the etchant alternate with the gases for forming the coating on the inside of the slots.

Figure 4C:
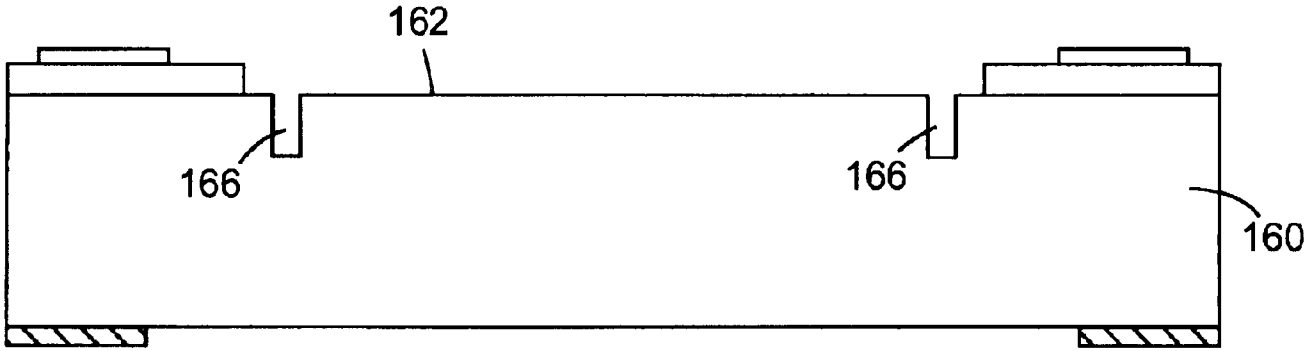

As illustrated in the embodiment of FIG. 4C, after slots 166 are formed in substrate 160, masking layer 180 is stripped or removed from substrate 160. As such, first side 162 of substrate 160 is revealed or exposed. In one embodiment, when masking layer 180 is formed of an oxide, masking layer 180 is removed, for example, by a chemical etch. In another embodiment, when masking layer 180 is formed of photoresist, masking layer 180 is removed, for example, by a resist stripper.

Figure 4D:
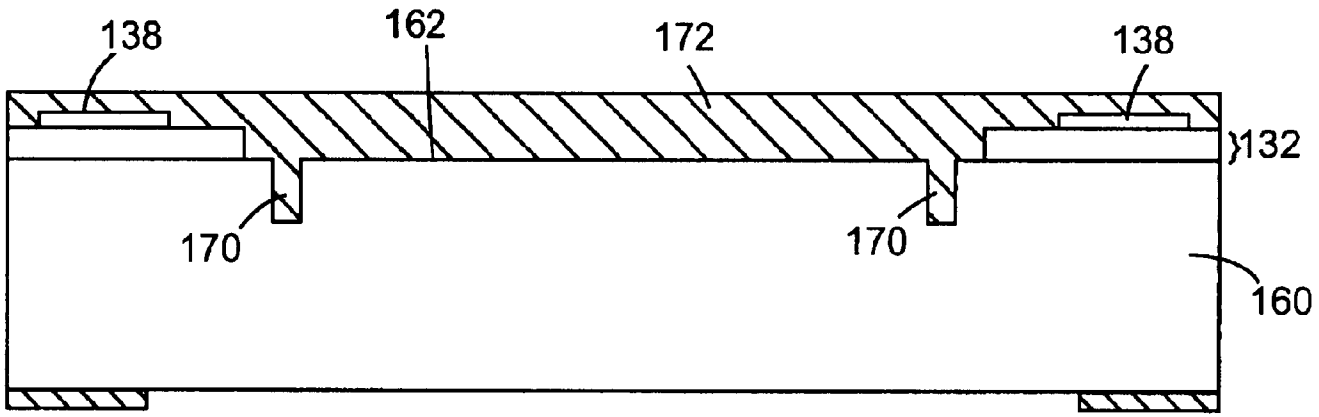

Next, as illustrated in the embodiment of FIG. 4D, etch stops 170 are formed in substrate 160. In one embodiment, etch stops 170 are formed by disposing an etch resistant material in slots 166 of substrate 160. In one embodiment, forming of etch stops 170 includes filling slots 166 and forming a layer 172 on first side 162 of substrate 160. In one embodiment, layer 172 is formed over thin-film structure 132 and firing resistors 138.

In one embodiment, etch stops 170 and layer 172 are formed by disposing a material in slots 166 and on first side 162. The material is resistant to the etchant selected for use in etching opening 150 through substrate 160, as described below. In one embodiment, etch stops 170 and layer 172 are formed of a conformal material which is spun-deposited on first side 162. In one embodiment, the material includes an epoxy and, more specifically, a photoimageable epoxy. An example of such a material includes SU8.

Figure 4E:
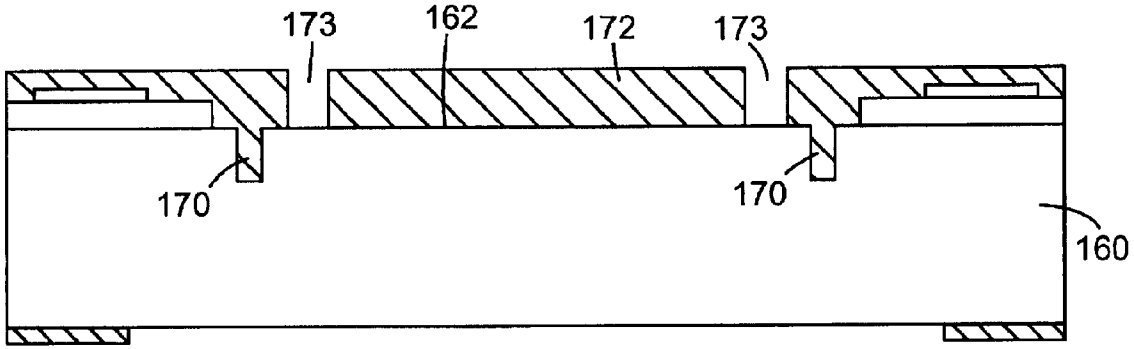
Figure 4F:
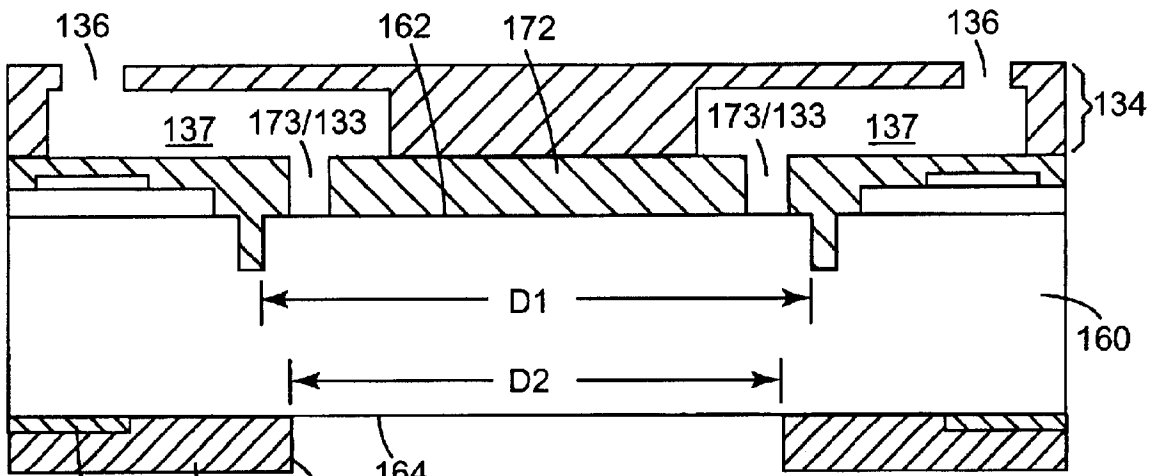
Figure 4G:
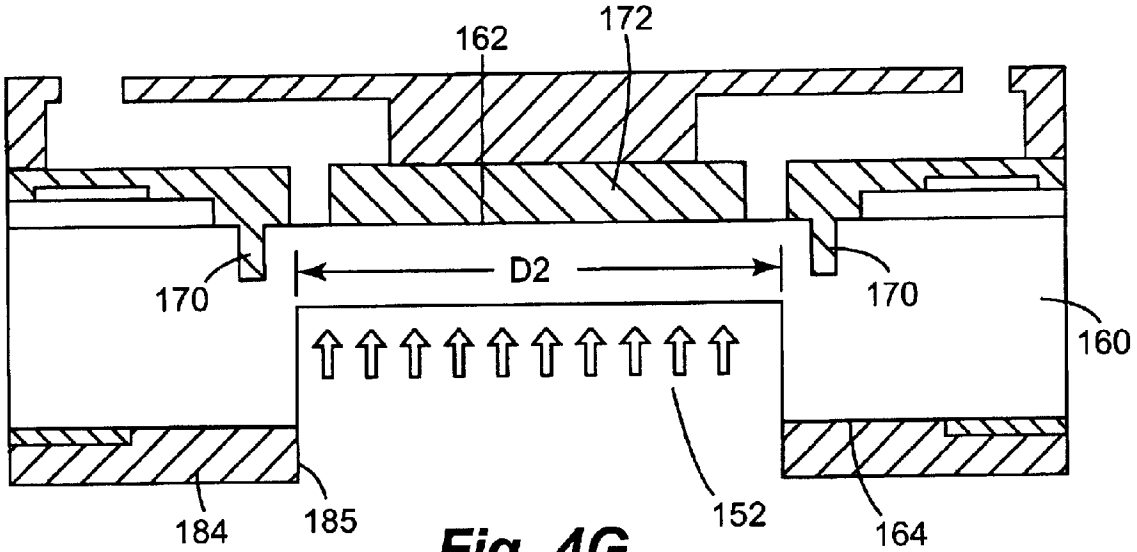
Figure 4H:
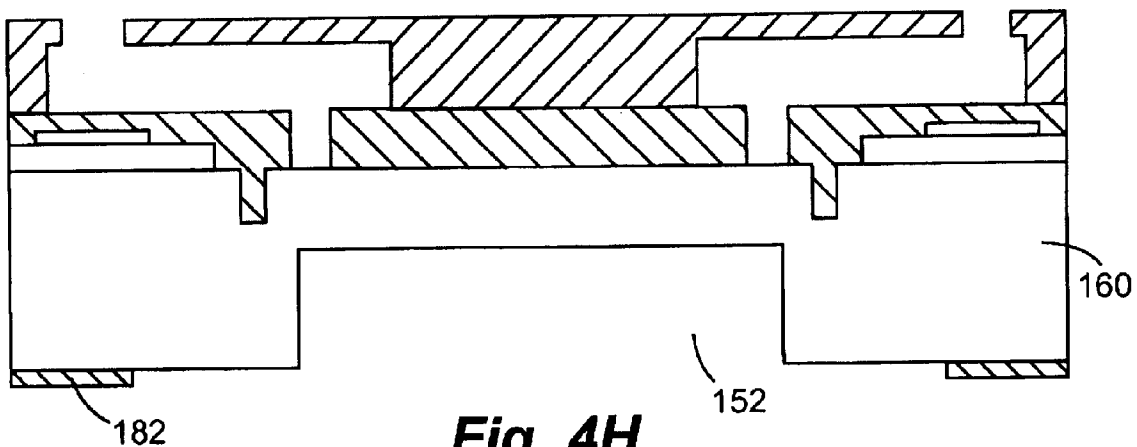
Figure 4I:
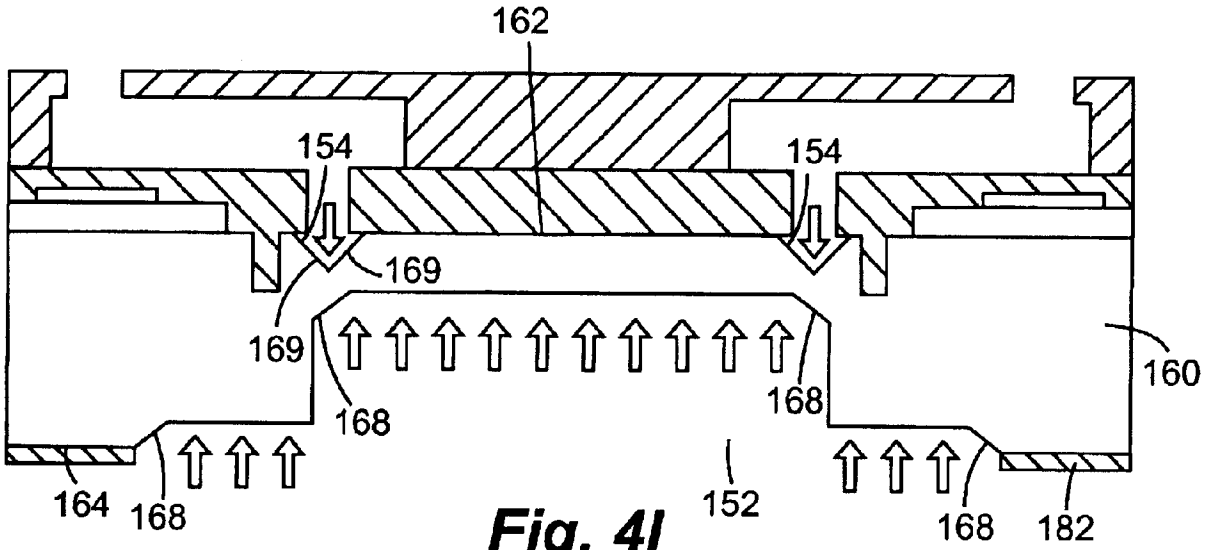
Figure 4J:
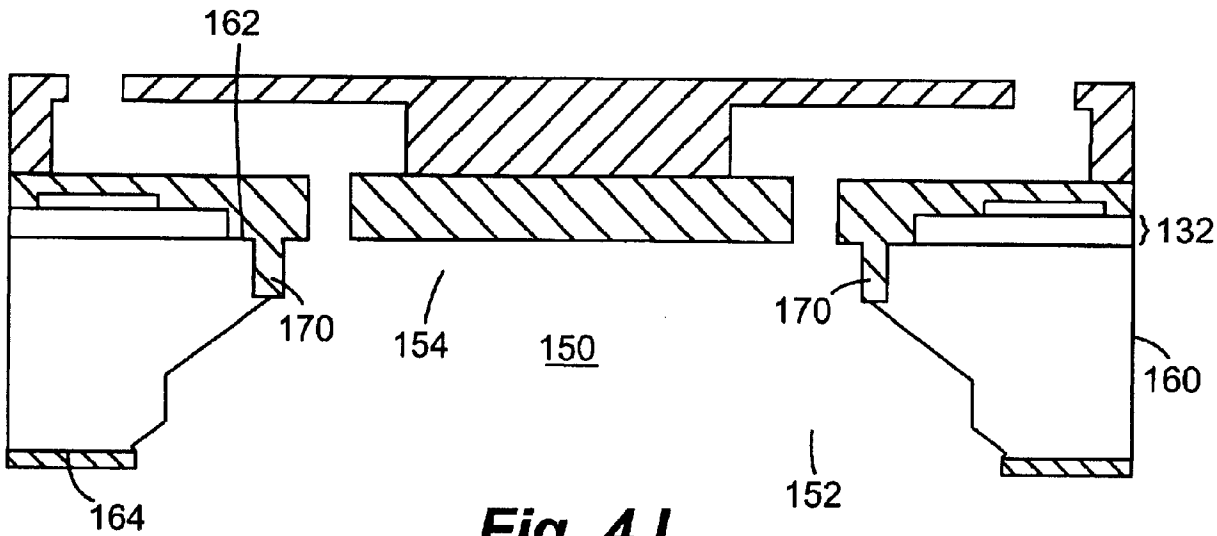

As illustrated in the embodiment of FIG. 4E, after etch stops 170 are formed in first side 162 and layer 172 is formed on first side 162, layer 172 is patterned to expose areas of first side 162 and define where substrate 160 is to be etched to form a portion of opening 150 (FIGS. 4I–4J). In one embodiment, layer 172 is patterned by photolithography to define exposed portions of first side 162 and define openings 173 in layer 172.

In one embodiment, as illustrated in the embodiment of FIG. 4F, orifice layer 134 including nozzle openings 136 and nozzle chambers 137 is formed on first side 162 of substrate 160. In one embodiment, orifice layer 134 is formed over layer 172. As such, openings 173 in layer 172 define fluid feed holes or channels 133 which communicate with corresponding nozzle chambers 137 formed in orifice layer 134.

Also, as illustrated in the embodiment of FIG. 4F, a masking layer 184 is formed on second side 164 of substrate 160. In one embodiment, masking layer 184 is formed on second side 164 over masking layer 182. Masking layer 184 is formed of a material which is resistant to the etchant used for forming opening 150 in substrate 160, as described below. The material may include, for example, photoresist. Masking layer 184 is patterned to expose an area of second side 164 and define an opening 185 where substrate 160 is to be etched to partially form a first portion 152 of opening 150 (FIGS. 4G–4H).

In one embodiment, etch stops 170 are spaced at a first dimension D1 in a first direction (i.e., a horizontal direction with reference to the FIGURES) and masking layer 184 is patterned to define opening 185 with a second dimension D2 in the first direction. In some embodiments, second dimension D2 is equal to or less than first dimension D1. In addition, second dimension D2 is typically positioned within first dimension D1.

As illustrated in the embodiment of FIG. 4G, first portion 152 of opening 150 is partially formed in substrate 160. In one embodiment, first portion 152 is partially formed by etching into substrate 160 from second side 164. As such, first portion 152 of opening 150 is partially formed by etching an exposed portion or area of substrate 160 within opening 185 of masking layer 184 from second side 164 toward first side 162.

In some embodiments, first portion 152 of opening 150 is partially formed using an anisotropic etch process which initially forms first portion 152 with substantially parallel sides. In one embodiment, the etch process is a dry etch, such as a plasma based fluorine ($SF_6$) etch. In a particular embodiment, the dry etch is a reactive ion etch (RIE) and, more specifically, a deep RIE (DRIE), as described above. It is, however, within the scope of the present invention for first portion 152 of opening 150 to be partially formed using other fabrication techniques such as laser machining.

When initially etching first portion 152 of opening 150 into substrate 160 from second side 164, masking layer 184 defines where substrate 160 is etched. As such, first portion 152 of opening 150 is initially formed with second dimension D2 in the first direction. In one embodiment, initial etching of first portion 152 is stopped before reaching first side 162 of substrate 160 and, more specifically, before reaching etch stops 170 in substrate 160. In another embodiment, initial etching of first portion 152 is continued between etch stops 170 to the side of layer 172 at first side 162 of substrate 160.

As illustrated in the embodiment of FIG. 4H, after first portion 152 of opening 150 is partially formed in substrate 160, masking layer 184 is stripped or removed from substrate 160. As such, masking layer 182 is revealed or exposed. In one embodiment, where masking layer 184 is formed of photoresist, masking layer 184 is removed, for example, by a resist stripper.

As illustrated in the embodiment of FIG. 4I, first portion 152 of opening 150 is further etched into substrate 160 from second side 164 and second portion 154 of opening 150 is etched into substrate 160 from first side 162. As such, first portion 152 of opening 150 is further formed by etching an exposed portion or area of substrate 160 from second side 164 toward first side 162 and second portion 154 of opening 150 is formed by etching exposed portions or areas of substrate 160 from first side 162 toward second side 164. Thus, first portion 152 of opening 150 and second portion 154 of opening 150 are simultaneously etched into substrate 160.

Typically, first portion 152 is further formed and second portion 154 is formed using an anisotropic chemical etch process. More specifically, the chemical etch process is a wet etch process and uses a wet anisotropic etchant such as tetra-methyl ammonium hydroxide (TMAH), potassium hydroxide (KOH), or other alkaline etchant. As such, a geometry of opening 150 through substrate 160 is defined by crystalline planes of the silicon substrate. For example, first portion 152 of opening 150 follows crystalline planes 168 of substrate 160 and second portion 154 of opening 150 follows crystalline planes 169 of substrate 160.

In one embodiment, substrate 160 has a <100> Si crystal orientation and the wet anisotropic etches of first portion 152 and second portion 154 follow <111> Si planes of substrate 160. As such, crystalline planes 168 and 169 include <111> Si planes of substrate 160. Thus, sides of first portion 152 of opening 150 and sides of second portion 154 of opening 150 are oriented at angles of approximately 54 degrees to second side 164 and first side 162, respectively.

As illustrated in the embodiment of FIG. 4J, etching into substrate 160 from second side 164 toward first side 162 and/or from first side 162 toward second side 164 continues such that first portion 152 and second portion 154 of opening 150 connect or communicate. As such, opening 150 is formed through substrate 160.

As described above, etch stops 170 are formed of a material resistant to the wet anisotropic etchant used to further form first portion 152 and form second portion 154 of opening 150. As such, etch stops 170 define a maximum dimension of second portion 154 and a minimum dimension of first portion 152, as described below. In addition, etch stops 170 establish a location of second portion 154 at first side 162 and accommodate misalignment between first portion 152 formed from second side 164 and second portion 154 formed from first side 162.

More specifically, when etching into substrate 160 from first side 162, etch stops 170 limit etching of substrate 160 to areas between etch stops 170 and prevent etching laterally of etch stops 170. As such, undercutting or etching into substrate 160 under the edges of layer 172 and, more specifically, thin-film structure 132 is avoided when etching into substrate 160 from first side 162. Thus, etch stops 170 define substantially vertical sidewalls of second portion 154 of opening 150 and control a width of opening 150 at first side 162. Etch stops 170, therefore, control where opening 150 communicates with first side 162.

Furthermore, when etching into substrate 160 from second side 164, etch stops 170 cause further etching of first portion 152 to self-terminate. More specifically, when further etching of first portion 152 reaches etch stops 170, etching of first portion 152 continues to follow the crystalline orientation or crystalline planes of substrate 160. For example, in one embodiment, as described above, etching of first portion 152 follows <111> Si planes of substrate 160. As such, when etching of first portion 152 reaches one or more etch stops 170, etching continues along <111> Si planes of substrate 160.

A depth at which etch stops 170 extend into substrate 160 from first side 162, however, is selected such that etching of first portion 152 toward first side 162 and beyond etch stops 170 self-terminates before reaching first side 162. As such, etch stops 170 provide for self-alignment between first portion 152 as formed from second side 164 and second portion 154 as formed from first side 162. More specifically, etch stops 170 accommodate misalignment between first portion 152 and second portion 154 by confining second portion 154 between spaced etch stops 170 and causing first portion 152 to self-terminate at etch stops 170. In addition, a dimension of second portion 154 of opening 150 is self-limiting and self-aligned by etch stops 170.

While the above description refers to the inclusion of substrate 160 having opening 150 formed therein in an inkjet printhead assembly, as one embodiment of a fluid ejection assembly of a fluid ejection system, it is understood that substrate 160 having opening 150 formed therein may be incorporated into other fluid ejection systems including non-printing applications or systems as well as other applications having fluidic channels through a substrate, such as medical devices. Accordingly, the present invention is not limited to printheads, but is applicable to any slotted substrates. In addition, while the above description refers to routing fluid or ink through opening 150 of substrate 160, it is understood that any flowable material, including a liquid such as water, ink, blood, photoresist, or organic light-emitting materials or flowable particles of a solid such as talcum powder or a powdered drug, may be fed or routed through opening 150 of substrate 160.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A method of forming an opening through a substrate having a first side and a second side opposite the first side, the method comprising:

forming spaced stops in the first side of the substrate;

partially forming a first portion of the opening in the substrate from the second side by a first process;

further forming the first portion of the opening in the substrate from the second side by a second process, including forming the first portion of the opening to the spaced stops; and forming a second portion of the opening in the substrate from the first side, including forming the second portion of the opening between the spaced stops.

2. The method of claim 1, wherein partially forming the first portion of the opening includes dry etching into the substrate from the second side.

3. The method of claim 2, wherein dry etching into the substrate includes deep reactive ion etching into the substrate.

4. The method of claim 1, wherein partially forming the first portion of the opening includes laser machining into the substrate from the second side.

5. The method of claim 1, wherein further forming the first portion of the opening includes wet etching into the substrate from the second side and terminating the wet etching with the spaced stops.

6. The method of claim 1, wherein forming the second portion of the opening includes wet etching into the substrate from the first side between the spaced stops.

7. The method of claim 1, wherein further forming the first portion of the opening and forming the second portion of the opening includes simultaneously etching into the substrate from the second side toward the first side and from the first side toward the second side.

8. The method of claim 1, wherein forming the spaced stops includes spacing the spaced stops at a first dimension in a first direction, and wherein partially forming the first portion of the opening includes partially forming the first portion of the opening with a second dimension one of equal to and less than the first dimension in the first direction.

9. The method of claim 8, wherein the second dimension is positioned within the first dimension.

10. The method of claim 1, wherein forming the spaced stops includes defining a maximum dimension of the second portion of the opening.

11. The method of claim 10, wherein forming the spaced stops further includes defining a minimum dimension of the first portion of the opening.

12. The method of claim 1, wherein forming the spaced stops includes extending the spaced stops into the substrate substantially perpendicular to the first side of the substrate.

13. The method of claim 1, wherein forming the spaced stops includes forming spaced slots in the first side of the substrate and disposing an etch resistant material in the spaced slots.

14. The method of claim 13, wherein forming the spaced slots includes etching into the substrate from the first side.

15. The method of claim 14, wherein etching into the substrate includes dry etching into the substrate.

16. The method of claim 15, wherein dry etching into the substrate includes deep reactive ion etching into the substrate.

17. The method of claim 13, wherein the substrate is formed of silicon and the etch resistant material includes an epoxy.

18. A method of forming a substrate for a fluid ejection device, the method comprising:

forming spaced stops in a first side of the substrate;

partially forming a first portion of a fluidic channel in the substrate from a second side opposite the first side by a first process;

further forming the first portion of the fluidic channel in the substrate from the second side by a second process, including forming the first portion of the fluidic channel to the spaced stops; and forming a second portion of the fluidic channel in the substrate from the first side, including forming the second portion of the fluidic channel between the spaced stops.

19. The method of claim 18, wherein partially forming the first portion of the fluidic channel includes dry etching into the substrate from the second side.

20. The method of claim 19, wherein dry etching into the substrate includes deep reactive ion etching into the substrate.

21. The method of claim 18, wherein partially forming the first portion of the fluidic channel includes laser machining into the substrate from the second side.

22. The method of claim 18, wherein further forming the first portion of the fluidic channel includes wet etching into the substrate from the second side and terminating the wet etching with the spaced stops.

23. The method of claim 18, wherein forming the second portion of the fluidic channel includes wet etching into the substrate from the first side between the spaced stops.

24. The method of claim 18, wherein further forming the first portion of the fluidic channel and forming the second portion of the fluidic channel includes simultaneously etching into the substrate from the second side toward the first side and from the first side toward the second side.

25. The method of claim 18, wherein forming the spaced stops includes spacing the spaced stops at a first dimension in a first direction, and wherein partially forming the first portion of the fluidic channel includes partially forming the first portion of the fluidic channel with a second dimension one of equal to and less than the first dimension in the first direction.

26. The method of claim 25, wherein the second dimension is positioned within the first dimension.

27. The method of claim 18, wherein forming the spaced stops includes defining a maximum dimension of the second portion of the fluidic channel.

28. The method of claim 27, wherein forming the spaced stops further includes defining a minimum dimension of the first portion of the fluidic channel.

29. The method of claim 18, wherein forming the spaced stops includes extending the spaced stops into the substrate substantially perpendicular to the first side of the substrate.

30. The method of claim 18, wherein forming the spaced stops includes forming spaced slots in the first side of the substrate and disposing an etch resistant material in the spaced slots.

31. The method of claim 30, wherein forming the spaced slots includes etching into the substrate from the first side.

32. The method of claim 31, wherein etching into the substrate includes dry etching into the substrate.

33. The method of claim 32, wherein dry etching into the substrate includes deep reactive ion etching into the substrate.

34. The method of claim 30, wherein the substrate is formed of silicon and the etch resistant material includes an epoxy.

35. The method of claim 30, wherein disposing the etch resistant material in the spaced slots further includes forming a layer of the etch resistant material on the first side of the substrate.

36. The method of claim 35, further comprising:

forming a firing resistor on the first side of the substrate, and wherein forming the layer of the etch resistant material includes forming the layer over the firing resistor.

37. A substrate for a fluid ejection device, the substrate comprising:

a first side;

a second side opposite the first side;

spaced stops formed in the first side of the substrate; and a fluidic channel communicating with the first side and the second side, wherein a first portion of the fluidic channel is partially formed in the substrate by a first process from the second side and further formed in the substrate by a second process from the second side to the spaced stops, and wherein a second portion of the fluidic channel is formed in the substrate from the first side between the spaced stops.

38. The substrate of claim 37, wherein the first process includes a dry etch process.

39. The substrate of claim 38, wherein the dry etch process includes a deep reactive ion etch process.

40. The substrate of claim 37, wherein the first process includes a laser machining process.

41. The substrate of claim 37, wherein the second process includes a wet etch process.

42. The substrate of claim 41, wherein the spaced stops terminate the wet etch process.

43. The substrate of claim 37, wherein the second portion of the fluidic channel is wet etched into the substrate.

44. The substrate of claim 37, wherein the spaced stops are spaced a first dimension in a first direction, and wherein the first process partially forms the first portion of the fluidic channel with a second dimension one of equal to and less than the first dimension in the first direction.

45. The substrate of claim 44, wherein the second dimension is positioned within the first dimension.

46. The substrate of claim 37, wherein the spaced stops define a maximum dimension of the second portion of the fluidic channel.

47. The substrate of claim 46, wherein the spaced stops further define a minimum dimension of the first portion of the fluidic channel.

48. The substrate of claim 37, wherein the spaced stops are oriented substantially perpendicular to the first side of the substrate.

49. The substrate of claim 37, wherein the spaced stops are formed in spaced slots of the substrate.

50. The substrate of claim 49, wherein the spaced slots are dry etched into the first side of the substrate.

51. The substrate of claim 50, wherein the spaced slots are deep reactive ion etched into the first side of the substrate.

52. The substrate of claim 37, wherein the substrate is formed of silicon, and wherein the spaced stops include an etch resistant material.

53. The substrate of claim 52, wherein the etch resistant material includes an epoxy.

54. The substrate of claim 53, wherein the epoxy includes a photoimageable material.

55. The substrate of claim 52, further comprising:

a layer of the etch resistant material formed on the first side of the substrate.

56. The substrate of claim 55, further comprising:

a firing resistor formed on the first side of the substrate, and wherein the layer of the etch resistant material is formed over the firing resistor.

* * * * *